US011800959B2

(12) United States Patent
Kleine-Doepke et al.

(10) Patent No.: US 11,800,959 B2
(45) Date of Patent: Oct. 31, 2023

(54) NOZZLE DEVICE COMPRISING AT LEAST ONE LIGHT-EMITTING SOURCE

(71) Applicant: KONINKLIJKE PHILIPS N.V., Eindhoven (NL)

(72) Inventors: Bastian Cornelis Kleine-Doepke, Eindhoven (NL); Jonne Steeman, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 18/017,641

(22) PCT Filed: Jun. 18, 2021

(86) PCT No.: PCT/EP2021/066702

§ 371 (c)(1),
(2) Date: Jan. 23, 2023

(87) PCT Pub. No.: WO2022/017698

PCT Pub. Date: Jan. 27, 2022

(65) Prior Publication Data

US 2023/0255428 A1 Aug. 17, 2023

(30) Foreign Application Priority Data

Jul. 23, 2020 (EP) ..... 20187356
Feb. 15, 2021 (EP) ..... 21157165

(51) Int. Cl.
*A47L 9/30* (2006.01)
*A47L 9/02* (2006.01)

(52) U.S. Cl.
CPC .. *A47L 9/30* (2013.01); *A47L 9/02* (2013.01)

(58) Field of Classification Search
CPC ..... A47L 9/30; A47L 9/02
See application file for complete search history.

(56) References Cited

U.S. PATENT DOCUMENTS 6,226,830 B1 * 5/2001 Hendriks ..... A47L 5/36 15/327.2
6,499,183 B1 12/2002 Paterson et al.
(Continued)

FOREIGN PATENT DOCUMENTS

CN 203447232 U 2/2014
CN 105072964 A 11/2015
(Continued)

OTHER PUBLICATIONS

Extended European Search Report issued in connection with corresponding EP Application No. 20187356.9 dated Dec. 9, 2020.

*Primary Examiner* — Marc Carlson
(74) *Attorney, Agent, or Firm* — Maschoff Brennan

(57) ABSTRACT

A nozzle device intended for use in a cleaning appliance such as a vacuum cleaner is described. The nozzle device can be moved over a surface to be cleaned. The nozzle device includes at least one light-emitting source arranged at a side of the nozzle device, and the at least one light-emitting source emits light from the respective side of the nozzle device. The nozzle device further includes a controlling arrangement for varying, at least one parameter of the at least one light-emitting source in relation to actual circumstances of a cleaning action between a functional value and at least one default value which is different from the functional value, and for setting the functional value of the parameter when the respective side is in the vicinity of an obstacle on the surface to be cleaned.

15 Claims, 3 Drawing Sheets

(56) References Cited

U.S. PATENT DOCUMENTS

| | | | | |
|---|---|---|---|---|
| 11,679,713 | B2 * | 6/2023 | White | A47L 9/2826 15/319 |
| 2003/0037402 | A1 * | 2/2003 | Paterson | A47L 9/2857 15/323 |
| 2022/0047137 | A1 * | 2/2022 | Isenberg | A47L 9/2805 |

FOREIGN PATENT DOCUMENTS

| | | | | | |
|---|---|---|---|---|---|
| CN | 204862974 | U | | 12/2015 | |
| CN | 105592766 | A | | 5/2016 | |
| CN | 106662877 | A | | 5/2017 | |
| DE | 102015109838 | A1 | * | 12/2016 | A47L 5/28 |
| EP | 1875844 | A1 | | 1/2008 | |
| JP | H10-234633 | A | | 9/1998 | |
| JP | H10234633 | A | * | 9/1998 | |
| JP | H11-155785 | A | | 6/1999 | |
| JP | 2008-212195 | A | | 9/2008 | |
| JP | 2016-511041 | A | | 4/2016 | |
| JP | 2017-144099 | A | | 8/2017 | |
| JP | 2018-196510 | A | | 12/2018 | |
| KR | 20090070740 | A | * | 7/2009 | |
| RU | 2707592 | C1 | | 11/2019 | |
| WO | WO-2020082066 | A1 | * | 4/2020 | A47L 11/302 |
| WO | WO-2021152292 | A1 | * | 8/2021 | A47L 11/4002 |

* cited by examiner

NOZZLE DEVICE COMPRISING AT LEAST ONE LIGHT-EMITTING SOURCE

CROSS-REFERENCE TO RELATED APPLICATIONS

The present application is a U.S. National Phase application under 35 U.S.C. § 371 of International Application No. PCT/EP2021/066702, filed on Jun. 18, 2021, which claims the benefit of European Patent Application No. 21157165.8, filed on Feb. 15, 2021, and European Patent Application No. 20187356.9, filed on Jul. 23, 2020. These applications are hereby incorporated by reference herein.

FIELD OF THE INVENTION

The invention relates to a nozzle device configured to face a surface to be cleaned and to be moved over the surface during a cleaning action.

BACKGROUND OF THE INVENTION

Current nozzle devices for various types of vacuum cleaners such as canister vacuum cleaners and stick vacuum cleaners are often equipped with front lights, i.e. lights at a side of the nozzle device which is configured to be at a front position during a cleaning action. Such lights may include one or more LEDs and serve to illuminate an area of the surface to be cleaned in front of the nozzle device during a cleaning action, so that a user of the vacuum cleaner including the nozzle device can easily recognize dirt on the surface area and assess whether or not the surface area is clean. Usually, the surface to be cleaned is a floor. Assessing whether or not dirt is present on surface areas at the sides of the nozzle device is more difficult. Those surface portions are often in the shadow of the nozzle device, and especially when the nozzle device is moved more or less parallel to a wall, along a path close to the wall, the narrow surface portion between the wall and the side of the nozzle device facing the wall is hardly visible. This is all the more the case when the nozzle device comprises the above-mentioned front lights, because it is even more difficult to spot dirt on a relatively dark surface area with eyes which are used to bright light.

It is a known fact that dirt tends to accumulate close to walls/plinths and obstacles because the dirt is practically not disturbed in those areas. In view thereof, it is desirable to have a nozzle device by means of which a vacuum cleaner is enabled to effectively perform cleaning at a side position. In this context, it is advantageous to provide illumination in a sideward direction relative to the nozzle device, so that a user can see how much dirt is present on a surface area at a side of the nozzle device, if the dirt gets sucked in, and if the surface area is clean once the nozzle device has passed.

JP H10 234633 A relates to a floor nozzle designed such that a side surface part of a main body thereof can be illuminated for the purpose of easily recognizing dust, etc. when cleaning a dark space. In particular, the floor nozzle is equipped with lamps arranged at both sides of the main body and open/close switches for turning the lamps on and off, wherein the open/close switches are operated in relation to rotational movements of an extension tube coupled to a connection tube extending from the main body.

SUMMARY OF THE INVENTION

It is an object of the invention to provide a nozzle device which comprises at least one light-emitting source arranged at a side of the nozzle device and configured to emit light from the respective side of the nozzle device, which is designed to enable sophisticated and versatile use of the at least one light-emitting source, and which is suitable for use in various types of cleaning appliances.

In view of the foregoing, the invention provides a nozzle device configured to face a surface to be cleaned and to be moved over the surface during a cleaning action, the nozzle device comprising:

- at least one light-emitting source arranged at a side of the nozzle device and configured to emit light from the respective side of the nozzle device, and
- a controlling arrangement configured to vary at least one parameter of the at least one light-emitting source in relation to actual circumstances of a cleaning action between a functional value and at least one default value which is different from the functional value, and to set the functional value of the parameter when the respective side is in the vicinity of an obstacle on the surface to be cleaned.

It follows from the foregoing that according to the invention, a nozzle device is equipped with at least one light-emitting source arranged at a side of the nozzle device and configured to emit light from the respective side of the nozzle device. It may particularly be so that the at least one light-emitting source is configured to emit light towards the surface to be cleaned. The side of the nozzle device at which the at least one light-emitting source is arranged may particularly be a side which is configured to be at a front position during a cleaning action or a side which is configured to be at a side position during a cleaning action. As indicated earlier, the surface to be cleaned is usually a floor. Further, the nozzle device comprises a controlling arrangement for varying at least one parameter of the at least one light-emitting source between a functional value and at least one default value. The parameter varying functionality of the controlling arrangement is related to actual circumstances of a cleaning action, wherein it is intended to set the functional value of the parameter when the side where the at least one light-emitting source is arranged is in the vicinity of an obstacle on the surface to be cleaned. In this way, the nature of the effective light output from the at least one light-emitting source can be varied and particularly be adapted when the side where the at least one light-emitting source is arranged is in the vicinity of an obstacle.

The term "obstacle on the surface to be cleaned" as used in the present text is to be understood so as to cover any item projecting from the surface, any peripheral delimitation of the surface and any item arranged on the surface. Practical examples of an obstacle include a wall/plinth and a piece of furniture or a part thereof such as a supporting leg.

For example, the at least one parameter of the at least one light-emitting source includes power supply to the at least one light-emitting source, wherein the at least one default value of the power supply is lower than the functional value of the power supply. In such a case, it may particularly be so that a default value of the power supply is zero and thereby associated with a deactivated state of the at least one light-emitting source. Consequently, it may particularly be so that during use of the nozzle device in a cleaning action, the at least one light-emitting source is not simply operated all the time, but only in situations in which the side of the nozzle device where the at least one light-emitting source is arranged is close to an obstacle on the floor. In this way, it is achieved that the nozzle device is particularly suitable to be applied in cordless vacuum cleaners. Plinth cleaning, for example, only takes about 5% of the time of a cleaning action, and it is an insight of the invention that the one or more light-emitting sources of a nozzle device do not need to be constantly kept in an activated state, but that it may be sufficient to only illuminate a floor area at a side of the nozzle device when the floor area is a narrow area which is delimited by the nozzle device on the one side thereof and an obstacle on the other side thereof.

By keeping the one or more light-emitting sources in a deactivated state as a default and only operating the one or more light-emitting sources when it is useful to do so, power is saved, which is particularly beneficial when the power is taken from a battery. Alternatively, the one or more light-emitting sources are continuously kept in an activated state during a cleaning action, wherein the one or more light-emitting sources are operated at a lower power level as a default and are only operated at a higher power level when it is useful to do so, i.e. when a side of the nozzle device where at least one light-emitting source is arranged is close to an obstacle. Also in that case power is saved.

Additionally or alternatively, the nozzle device comprises a coverage arrangement configured to cover the at least one light-emitting source to a variable extent, wherein the at least one parameter of the at least one light-emitting source includes the extent to which the at least one light-emitting source is covered by the coverage arrangement. In such a case, the nature of the effective light output from the at least one light-emitting source is not (only) controlled through power supply to the at least one light-emitting source, but (also) through extent of coverage of the at least one light-emitting source. It is practical if the coverage arrangement comprises one of a movably arranged coverage element made of opaque material and a movably arranged coverage element made of colored transparent or semi-transparent material. In the first case, the amount of light emitted from the nozzle device at the position of the at least one light-emitting source can be varied, whereas in the second case, the color and possibly also the amount of light emitted from the nozzle device at the position of the at least one light-emitting source can be varied. In any case, it is practical if the functional value of the extent to which the at least one light-emitting source is covered by the coverage arrangement is lower than the default value thereof, probably zero so that when a side where at least one light-emitting source is arranged is in the vicinity of an obstacle on the surface to be cleaned, the at least one light-emitting source is freely exposed.

According to one option covered by the invention, the controlling arrangement comprises at least one actuation part which is accessible at the outside of the nozzle device, wherein the controlling arrangement is configured to set the functional value of the parameter when the actuation part is contacted by an obstacle on the surface to be cleaned. For example, the at least one actuation part of the controlling arrangement may be constituted by the optional movably arranged coverage element mentioned in the foregoing, in which case the coverage element is configured to be automatically moved to the appropriate positions when moving in and out of contact with an obstacle.

According to another option covered by the invention, different from the option described in the preceding paragraph, which may be qualified so as to involve passive actuation of the controlling arrangement to set the functional value of the at least one parameter of the at least one light-emitting source, it is possible to have active actuation of the controlling arrangement to set the functional value of the at least one parameter of the at least one light-emitting source. This can be achieved when the controlling arrangement is configured to assess whether or not an obstacle on the surface to be cleaned is present at an actual distance to a reference position on the nozzle device at the respective side which is equal to or smaller than a reference distance. In this respect, it is practical if the controlling arrangement includes at least one proximity sensor configured to determine the actual distance through distance detection. Having at least one proximity sensor located at a side of the nozzle device enables automatic recognition of situations in which the side is close to an obstacle. The number of proximity sensors of the controlling arrangement may have any suitable value, and the proximity sensors may be of any suitable type.

It is advantageous if the at least one proximity sensor is of the type including an output switching circuit, so that whether or not the functional value of the at least one parameter of the at least one light-emitting source is set is dependent on the state of the output switching circuit of the at least one proximity sensor. In particular, it may be so that the at least one proximity sensor is configured to have the output switching circuit in an opened state as a default, and to only have the output switching circuit in a closed state when the actual distance determined by the at least one proximity sensor is equal to or smaller than the reference distance. This allows for having a default situation of interrupting power supply needed for setting the functional value of the at least one parameter of the at least one light-emitting source, and to only enable such power supply when an obstacle is detected at close range.

The reference distance may have any suitable value, wherein it is noted that 50 mm is a practical example. In general, the reference distance may be in a range of 0-150 mm or even 0-200 mm.

In a practical embodiment of the nozzle device according to the invention, the at least one light-emitting source is arranged at at least one of a side of the nozzle device which is configured to be at a side position during a cleaning action and a side of the nozzle device which is configured to be at a front position during a cleaning action. For example, it may be so that the nozzle device comprises a side light-emitting source arranged at a side of the nozzle device which is configured to be at a side position during a cleaning action, a side light-emitting source arranged at a side of the nozzle device which is configured to be at an opposite side position during a cleaning action, and a front light-emitting source arranged at a side of the nozzle device which is configured to be at a front position during a cleaning action, wherein the controlling arrangement is configured to vary at least one parameter of at least each of the light-emitting sources in relation to actual circumstances of a cleaning action independently from the others of the light-emitting sources.

For the sake of clarity, it is noted that in the present text, references to a front or sides of the nozzle device are to be understood so as to be related to an intended direction of (forward) movement of the nozzle device along a surface to be cleaned during use thereof for cleaning the surface. It is practical if the nozzle device has a generally rectangular periphery at a bottom level, but that does not alter the fact that another shape of the periphery is possible as well. When the nozzle device is equipped with side light-emitting sources arranged at opposite sides of the nozzle device, it is possible to illuminate areas of the surface to be cleaned which are at the sides of the nozzle device. When, additionally or alternatively, the nozzle device is equipped with a front light-emitting source, it is possible to illuminate an area of the surface to be cleaned which is at the front of the nozzle device. The invention covers an option of varying at least one parameter of the front light-emitting source in relation to actual circumstances of a cleaning action, which does not alter the fact that it may be practical to simply realize effective light output from the front light-emitting source of a predetermined nature throughout a cleaning action.

In a situation in which the controlling arrangement of the nozzle device is configured to vary power supply to each one of the side light-emitting sources such that the light-emitting source is only put to an activated state when the side of the nozzle device where the light-emitting source is arranged is close to an obstacle, it is to be expected that during a cleaning action of a floor, both side light-emitting sources will mostly be in the deactivated state. Only when the nozzle device is moved alongside an obstacle such as a wall/plinth, one of the side light-emitting sources is put to an activated state, while the other of the side light-emitting sources is kept in the deactivated state unless the side of the nozzle device where that other of the side light-emitting sources is located also happens to be close to an obstacle, which may occur when the nozzle device is moved between a wall/plinth and a piece of furniture which is positioned close to the wall/plinth, for example.

Especially when the invention involves side illumination from the nozzle device, it is practical if the nozzle device is actually capable of picking up dirt from floor areas at the side of the nozzle device. In general, it is practical if at each of the sides of the nozzle device which are configured to be at a side position during a cleaning action, the nozzle device comprises at least one opening providing access from an exterior to an interior of the nozzle device so as to allow the nozzle device to receive dirt as may be present on the surface to be cleaned near the sides of the nozzle device.

It may be advantageous if the at least one light-emitting source comprises at least one LED. In an example in which a front light-emitting source comprising four LEDs is normally involved in the design of the nozzle device and two side light-emitting sources each comprising one LED are added to the design, it is found that if the side light-emitting sources would be operated all the time during a cleaning action without any restrictions, this would involve a continuous 50% increase of consumption of power used for illumination compared to a situation in which only the front light-emitting source would continually be operated. If power supply to the side light-emitting sources is varied between zero as a default and a functional value when a side where a side light-emitting source is arranged is in the vicinity of an obstacle, the resulting customized use of the side light-emitting sources only involves a 25% increase of consumption of power used for illumination during limited periods of time during a cleaning action, and, in extraordinary cases, possibly also a 50% increase of consumption of power used for illumination during one or more limited periods of time during the cleaning action. Apart from that, there is no increase of consumption of power at all.

The invention covers any possible embodiment of the at least one light-emitting source. Thus, besides the above-described embodiment in which the at least one light-emitting source comprises at least one LED, various other embodiments are feasible in the context of the invention. For example, it may be so that the at least one light-emitting source comprises at least one light-outcoupling portion of a light guide that further includes a light-incoupling portion configured to receive light from a light-supplying source.

It may be so that the nozzle device comprises a battery configured to supply electric energy, wherein the at least one light-emitting source is powered by the battery. It is also possible that the nozzle device is configured to electrically connect to a battery located in a body of a cordless cleaning appliance. The invention is really useful in the field of battery-operated cleaning appliances, which does not alter the fact that energy supply through a battery is not an essential aspect of the invention. Thus, the nozzle device may be used as part of a cordless cleaning appliance, but this is not necessary. When a battery is used, it is practical of the battery is of the rechargeable type. Further practical options covered by the invention include

- an option of having a design of the nozzle device in which the nozzle device comprises a vacuum arrangement configured to enable the nozzle device to subject the surface to be cleaned to a vacuum cleaning action, and
- an option of having a design of the nozzle device in which the at least one light-emitting source is integrated in a housing of the nozzle device.

The above-described and other aspects of the invention will be apparent from and elucidated with reference to the following detailed description of a practical embodiment of a nozzle device which is equipped with front and side light-emitting sources.

BRIEF DESCRIPTION OF THE DRAWINGS

The invention will now be explained in greater detail with reference to the figures, in which equal or similar parts are indicated by the same reference signs, and in which:

FIG. 2 illustrates aspects of the way in which the effective light output from the side light-emitting sources is controlled during operation of the nozzle device, FIGS. 3 and 4 diagrammatically show a perspective view of a nozzle device according to a second embodiment of the invention, which nozzle device comprises a front light-emitting source, two side light-emitting sources and a coverage arrangement of the side light-emitting sources, wherein

DETAILED DESCRIPTION OF EMBODIMENTS

Figure 1:
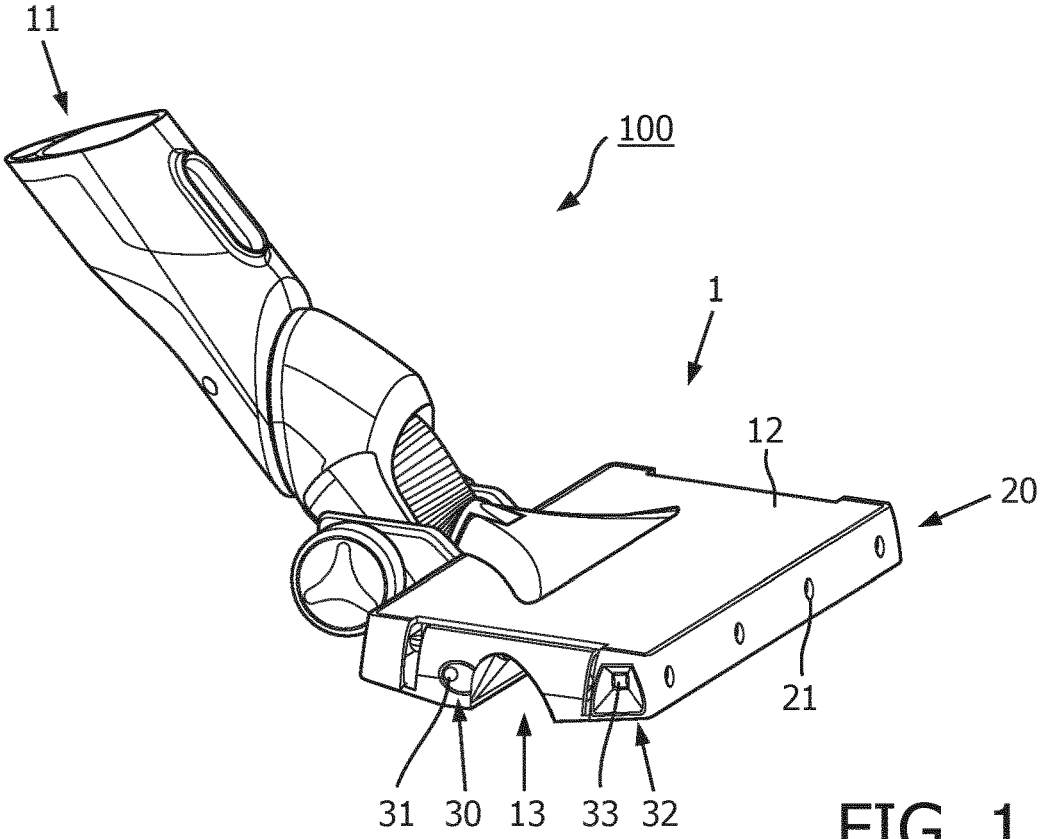
FIG. 1 diagrammatically shows a perspective view of a nozzle device according to a first embodiment of the invention, which nozzle device comprises a front light-emitting source and two side light-emitting sources.
Figure 2:
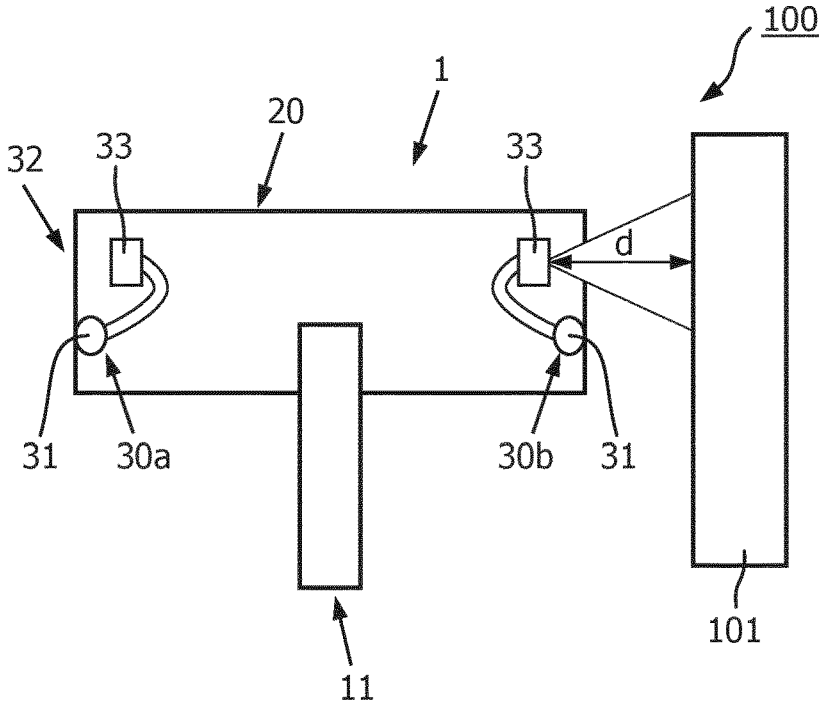

FIGS. 1 and 2 relate to a nozzle device 1 according to a first embodiment of the invention. The nozzle device 1 as shown is suitable to be used as a part of a vacuum cleaner, i.e. a cleaning appliance which generates a suction force to create a partial vacuum for sucking up dirt from a surface 100 to be cleaned. During a vacuum cleaning action, the nozzle device 1 is moved over the surface 100 to be cleaned so as to achieve that various areas of the surface 100 are subjected to the vacuum cleaning action until the entire surface 100 is covered. An example of a surface 100 to be cleaned is a floor. Examples of dirt include dust, particles, fibers, hairs, dirty liquid, etc. The nozzle device 1 has a nozzle outlet 11 which is connectable to a dirt collecting position in the vacuum cleaner through a tube, a hose or the like. It is practical if the nozzle device 1 is removably arranged in the vacuum cleaner, but this is not essential in the framework of the invention.

In order to enable a user to have a clear sight on floor areas towards which the nozzle device 1 is moved during a vacuum cleaning action, i.e. floor areas at the front of the nozzle device 1, the nozzle device 1 is equipped with a front light-emitting source 20 located at the front of the nozzle device 1. In the shown example, the front light-emitting source 20 comprises as much as four LEDs 21, wherein the LEDs 21 are integrated in a housing 12 of the nozzle device 1. By driving the front light-emitting source 20 to emit light throughout a vacuum cleaning action, it is achieved that the user is enabled to continuously check the extent to which the floor 100 needs cleaning in an area at a position in front of the nozzle device 1.

Further, the nozzle device 1 is equipped with two side light-emitting sources 30, wherein the one 30*a* of the two side light-emitting sources 30 is located at the one side of the nozzle device 1 and the other 30*b* of the two side light-emitting sources 30 is located at the other side of the nozzle device 1, as can be seen in FIG. 2. The side light-emitting sources 30 are configured to emit light in a sideward direction relative to the nozzle device 1. In the shown example, each of the side light-emitting sources 30 includes a single LED 31. The nozzle device 1 comprises a controlling arrangement 32 which serves for controlling each of the side light-emitting sources 30 in such a way that the side light-emitting source 30 is only activated when the side of the nozzle device 1 at which the side light-emitting source 30 is arranged is close to an obstacle 101 on the floor 100 such as a wall/plinth, and is kept in a deactivated state the rest of the time. According to a practical option, the controlling arrangement 32 comprises proximity sensors 33 arranged on the nozzle device 1 at each of the sides of the nozzle device 1, wherein each of the proximity sensors 33 is configured to detect an actual distance d between a reference position on the nozzle device 1, which may be the very position of the proximity sensor 33, and an obstacle 101 as may be present in the vicinity of the respective side, as is the case in the shown embodiment. The respective side light-emitting source 30 is only activated during a period of time that the actual distance d is equal to or smaller than a reference distance. Hence, as long as the actual distance d is not equal to or smaller than the reference distance, the side light-emitting source 30 is not put to an activated state. In this way, power used for illumination is saved, which may especially be beneficial when the power is supplied by a battery. In this respect, it is noted that the nozzle device 1 may comprise a battery for powering both the front light-emitting source 20 and the side light-emitting sources 30.

In FIG. 2, a detection range of the proximity sensor 33 is diagrammatically depicted as a triangular zone. The detection range may be cone-shaped, for example. An electric connection between the proximity sensor 33 and the side light-emitting source 30 is diagrammatically depicted as a curved set of lines. Only when the proximity sensor 33 detects an obstacle 101 at a distance d which is equal to or smaller than the reference distance, the side light-emitting source 30 is caused to be activated. Otherwise, the side light-emitting source 30 is kept in the deactivated state.

The nozzle device 1 is designed to suck up dirt from the floor 100 at the front of the nozzle device 1. Also, the nozzle device 1 comprises at least one opening 13 at each of the sides thereof, particularly an opening 13 for allowing the nozzle device 1 to suck up dirt from the floor 100 at those sides. When the vacuum cleaner including the nozzle device 1 is used to remove dirt from a floor 100, the dirt is displaced from an exterior to an interior of the nozzle device 1 and is transported to the dirt collecting position in the vacuum cleaner. The dirt is picked up at the front and at the sides of the nozzle device 1. The front light-emitting source 20 is continuously operated to emit light in a forward direction relative to the nozzle device 1, so that a user can continuously inspect the presence of dirt on the floor 100. The side light-emitting sources 30 are mostly kept in a deactivated state, and a side light-emitting source 30 is only operated to emit light in a sideward direction relative to the nozzle device 1 in a situation in which the side at which the side light-emitting source 30 is located is close to an obstacle 101. Thus, the user sees that light is continuously emitted from the front of the nozzle device 1, and also that light emission from a side of the nozzle device 1 starts when the side comes within range of an obstacle 101 and is terminated again as soon as the side has been moved away from the obstacle 101 again along a certain distance. The light emitted from a side of the nozzle device 1 helps the user in assessing whether or not the area of the floor 100 which is present between the side of the nozzle device 1 and an obstacle 101, and which would otherwise be dark, is clean to a sufficient extent.

Figure 3:
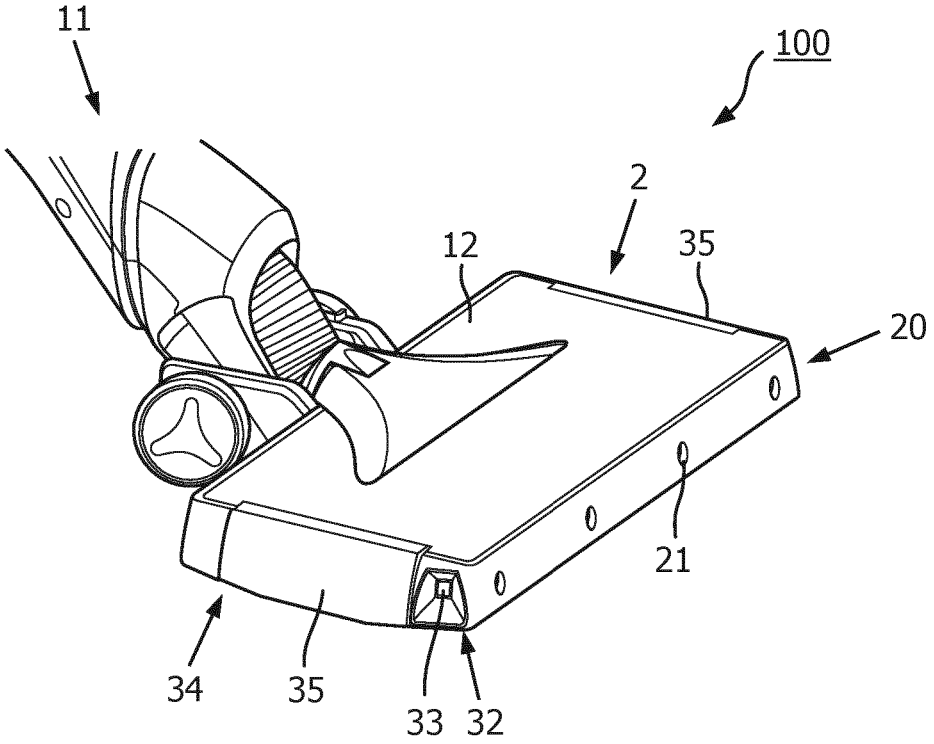
FIGS. 3 and 4 illustrate different positions of a coverage element included in the coverage arrangement, and FIG. 5 diagrammatically shows aspects of a nozzle device according to a third embodiment of the invention.
Figure 4:
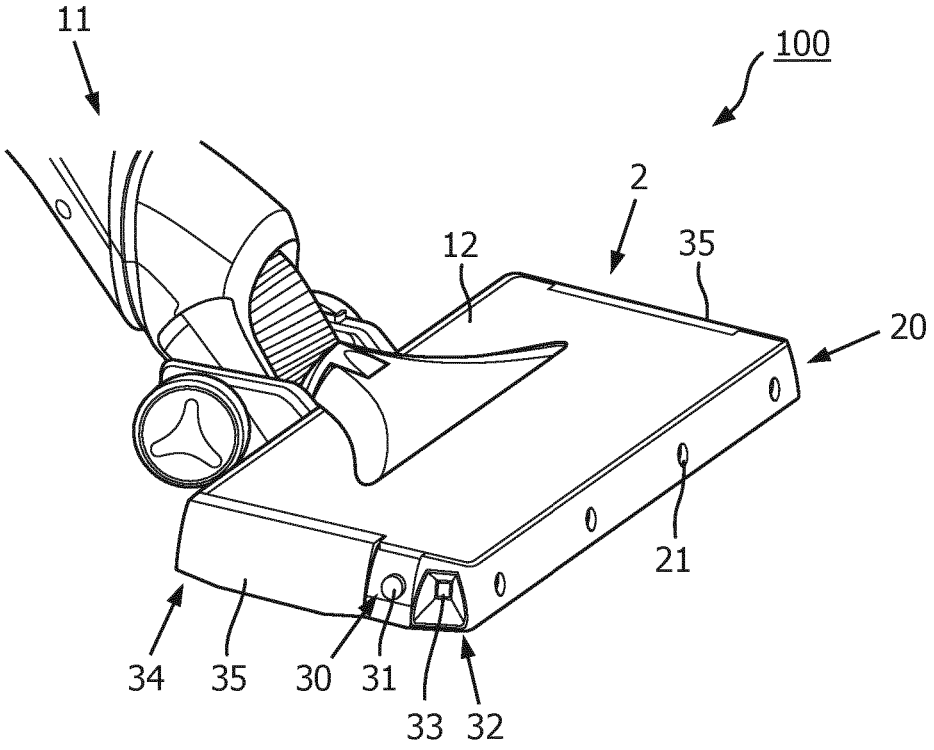

FIGS. 3 and 4 relate to a nozzle device 2 according to a second embodiment of the invention, which resembles the nozzle device 1 according to the first embodiment of the invention to a considerable extent. Among other things, the nozzle device 2 according to the second embodiment 2 also comprises a nozzle outlet 11, a housing 12, a front light-emitting source 20, side light-emitting sources 30 and a controlling arrangement 32 including proximity sensors 33 located at each of the sides of the nozzle device 2. A difference between the two nozzle devices 1, 2 is found in the way in which the effective light output from the side light-emitting sources 30 is controlled during operation of the nozzle device 1, 2. As explained in the foregoing, in the nozzle device 1 according to the first embodiment of the invention, controlling the effective light output from the side light-emitting sources 30 is done through controlling each of the side light-emitting sources 30 in such a way that the side light-emitting source 30 is only activated when the side of the nozzle device 1 at which the side light-emitting source 30 is arranged is close to an obstacle 101 on the floor 100, and is kept in a deactivated state the rest of the time. The nozzle device 2 according to the second embodiment of the invention is designed to enable variation of the effective light output from the side light-emitting sources 30 as well, but this is done by varying an extent to which the side light-emitting sources 30 are covered, as will become apparent from the following.

The nozzle device 2 according to the second embodiment of the invention comprises a coverage arrangement 34 configured to cover the light-emitting sources 30 to a variable extent. The coverage arrangement 34 comprises, at each of the sides of the nozzle device 2, a movably arranged coverage element 35. In the shown example, the coverage element 35 is made of opaque material and is movable between a first position for fully exposing the respective side light-emitting source 30 and a second position for fully covering the respective side light-emitting source 30, wherein the second position is the default position. Thus, the effective light output from the side light-emitting source 30 can be controlled on the basis of the fact that light shines freely from the side light-emitting source 30 when the coverage element 35 is in the first position and that light emitted by the side light-emitting source 30 is blocked from reaching the surroundings of the nozzle device 2 when the coverage element 35 is in the second position.

The coverage arrangement 34 can be of any suitable design. In the shown example, the two coverage elements 35 included in the coverage arrangement 34 are generally shaped like strips. The coverage elements 35 can be arranged on the nozzle device 2 in any suitable way. In the shown example, the coverage elements 35 are slidable in a horizontal direction, which does not alter the fact that other possibilities are covered by the invention as well. Further, the coverage elements 35 do not necessarily need to be made of opaque material. According to an alternative option, the coverage elements 35 may be made of colored transparent or semi-transparent material. In such a case, the effective light output can be varied between a reduced and possibly colored default value and a higher value.

In the nozzle device 2 as shown, the position of the coverage elements 35 is set by means of the controlling arrangement 32 including the proximity sensors 33. As explained in the foregoing in respect of the nozzle device 1 according to the first embodiment of the invention, each of the proximity sensors 33 is configured to detect an actual distance between a reference position on the nozzle device 2 and an obstacle 101 as may be present in the vicinity of the respective side. The respective coverage element 35 is only put to the position for fully exposing the respective side light-emitting source 30 during a period of time that the actual distance is equal to or smaller than a reference distance. Hence, as long as the actual distance is not equal to or smaller than the reference distance, the coverage element 35 is kept in the default position for fully covering the side light-emitting source 30.

As already suggested in respect of the nozzle device 1 according to the first embodiment of the invention, it may be so that the front light-emitting source 20 is continuously operated to emit light in a forward direction relative to the nozzle device 2, so that a user can continuously inspect the presence of dirt on the floor 100. The light emitted by the side light-emitting sources 30 is mostly blocked by the coverage elements 35, and a side light-emitting source 30 is only fully exposed in a situation in which the side at which the side light-emitting source 30 is located is close to an obstacle 101. Thus, the user sees that light is continuously emitted from the front of the nozzle device 2, and also that light starts to shine from a side of the nozzle device 2 when the side comes within range of an obstacle 101 and is hidden again as soon as the side has been moved away from the obstacle 101 again along a certain distance.

It is to be noted that it is possible to have a combination of the effective light output controlling methods of the nozzle device 1 according to the first embodiment of the invention and the nozzle device 2 according to the second embodiment of the invention. In such a case, each of the side light-emitting sources 30 is operated at a lower power level or totally shut off and also fully covered by the coverage element 35 as a default and only operated at a higher power level and fully exposed when the side where the side light-emitting source 30 is arranged is in the vicinity of an obstacle 101 on the floor 100. The effective light output controlling methods may also be applied to the front light-emitting source 20 and the preceding remark about the possibility of a combination is equally applicable in this respect.

Figure 5:
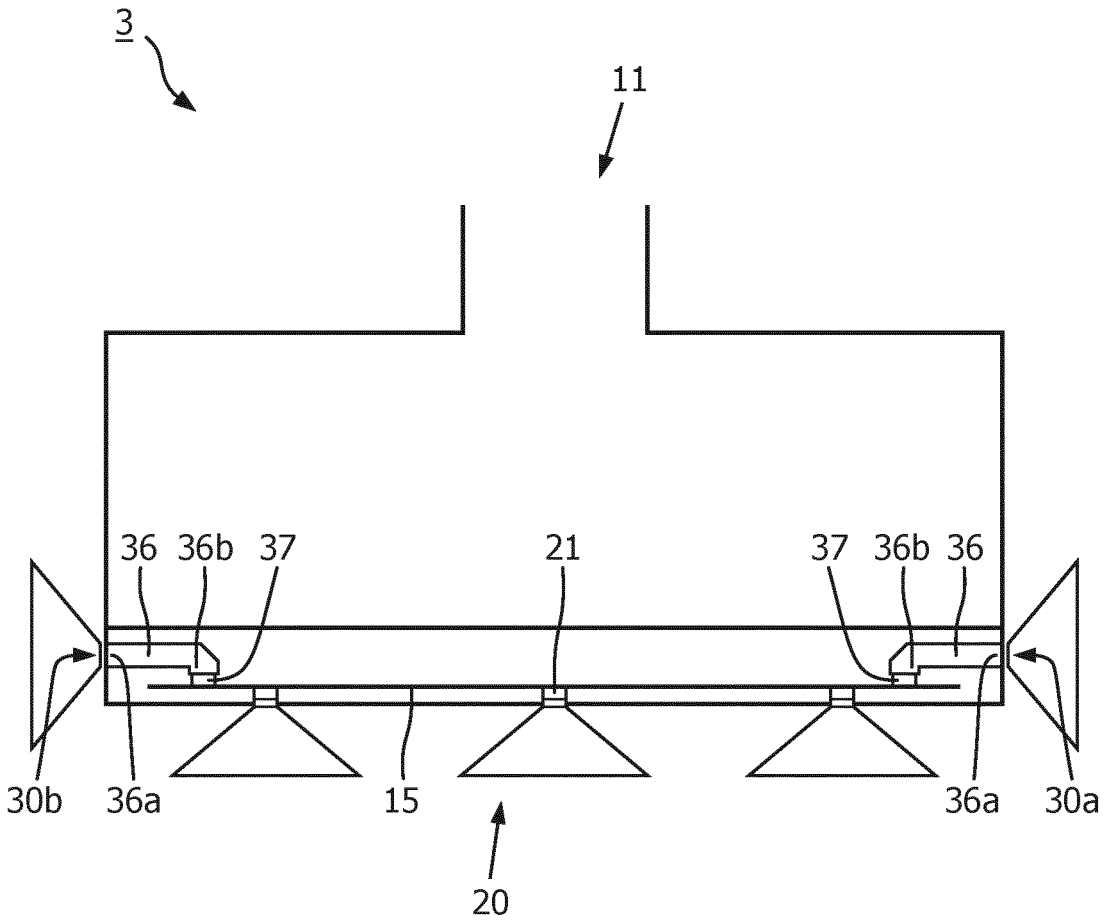

The light-emitting sources 20, 30 do not necessarily need to comprise light-generating devices such as LEDs. With reference to FIG. 5, in which aspects of a nozzle device 3 according to a third embodiment of the invention are illustrated, it is noted that alternatives are feasible, such as alternatives relying on light guide techniques. In general, an advantage of using light guides resides in robustness of construction and flexibility of design.

FIG. 5 diagrammatically shows a top view of a nozzle device 3 in which each of the two side light-emitting sources 30*a*, 30*b* comprises a light-outcoupling portion 36*a* of a light guide 36 that further includes a light-incoupling portion 36*b* configured to receive light from a light-supplying source 37. In the shown example, the light-supplying source 37 that is arranged to supply light to the light guide 36 is located on a printed circuit board assembly 15 that further supports and powers the front light-emitting source 20. The light-supplying source 37 may comprise a light-generating device such as an LED, for example, or may be realized in another suitable manner. For the sake of clarity, it is noted that light emitted by the light-emitting sources 20, 30 of the nozzle device 30 is indicated in FIG. 5 as respective cone-shaped areas. Further, it is noted that the controlling arrangement 32 is omitted from the diagrammatic representation of FIG. 5. In general, controlling the effective light output of the light-emitting sources 20, 30 of the nozzle device 3 may take place in any suitable way, including by controlling power supply to the light-emitting sources 20, 30, controlling an extent of coverage of the light-emitting sources 20, 30, or a combination thereof, as described in the foregoing.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. A nozzle device 1, 2, 3 is intended for use in a cleaning appliance such as a vacuum cleaner, and is configured to be moved over a surface 100 to be cleaned. The nozzle device 1, 2, 3 comprises at least one light-emitting source 20, 30 arranged at a side of the nozzle device 1, 2, 3 and configured to emit light from the respective side of the nozzle device 1, 2, 3, and a controlling arrangement 32 configured to vary at least one parameter of the at least one light-emitting source 20, 30 in relation to actual circumstances of a cleaning action between a functional value and at least one default value which is different from the functional value, and to set the functional value of the parameter when the respective side is in the vicinity of an obstacle 101 on the surface 100 to be cleaned.

According to a first practical example, the at least one parameter of the at least one light-emitting source 20, 30 includes power supply to the at least one light-emitting source 20, 30. In such a case, it can be achieved that power supply to the at least one light-emitting source 20, 30 is normally at a relatively low default value and is put to a higher functional value when the respective side is in the vicinity of an obstacle 101 on the surface 100 to be cleaned so that effective light output is increased in that situation, possibly from no effective light output at all as a default. According to a second practical example, the at least one parameter of the at least one light-emitting source 20, 30 includes an extent to which the at least one light-emitting source 20, 30 is covered. In such a case, it can be achieved that the at least one light-emitting source 20, 30 is normally fully covered and is at least partially exposed when the respective side is in the vicinity of an obstacle 101 on the surface 100 to be cleaned so that effective light output is increased in that situation, possibly from no effective light output at all as a default when an opaque coverage element 35 is used.

The invention claimed is:

1. A nozzle device configured to face a surface to be cleaned and to be moved over the surface during a cleaning action, the nozzle device comprising:

at least one light-emitting source arranged at a side of the nozzle device and configured to emit light from the respective side of the nozzle device; and a controlling arrangement, wherein the controlling arrangement is configured to vary at least one parameter of the at least one light-emitting source in relation to actual circumstances of the cleaning action between a functional value and at least one default value which is different from the functional value, and to set the functional value of the parameter when the respective side is in the vicinity of an obstacle on the surface to be cleaned.

2. The nozzle device of claim 1, wherein the at least one parameter of the at least one light-emitting source includes power supply to the at least one light-emitting source, and wherein the at least one default value of the power supply is lower than the functional value of the power supply.

3. The nozzle device of claim 2, wherein a default value of the power supply is zero and thereby associated with a deactivated state of the at least one light-emitting source.

4. The nozzle device of claim 1, further comprising a coverage arrangement configured to cover the at least one light-emitting source to a variable extent, wherein the at least one parameter of the at least one light-emitting source includes the extent to which the at least one light-emitting source is covered by the coverage arrangement.

5. The nozzle device of claim 4, wherein the coverage arrangement comprises one of a movably arranged coverage element made of opaque material and a movably arranged coverage element made of colored transparent or semi-transparent material.

6. The nozzle device of claim 1, wherein the controlling arrangement comprises at least one actuation part which is accessible at the outside of the nozzle device, and wherein the controlling arrangement is configured to set the functional value of the parameter when the actuation part is contacted by the obstacle on the surface to be cleaned.

7. The nozzle device of claim 1, wherein the controlling arrangement is configured to assess whether or not the obstacle on the surface to be cleaned is present at an actual distance to a reference position on the nozzle device at the respective side which is equal to or smaller than a reference distance.

8. The nozzle device of claim 7, wherein the controlling arrangement includes at least one proximity sensor configured to determine the actual distance through distance detection.

9. The nozzle device of claim 1, wherein the at least one light-emitting source is arranged at at least one of a side of the nozzle device which is configured to be at a side position during the cleaning action and a side of the nozzle device which is configured to be at a front position during the cleaning action.

10. The nozzle device of claim 1, comprising a side light-emitting source arranged at a side of the nozzle device which is configured to be at a side position during the cleaning action, a side light-emitting source arranged at a side of the nozzle device which is configured to be at an opposite side position during the cleaning action, and a front light-emitting source arranged at a side of the nozzle device which is configured to be at a front position during the cleaning action, wherein the controlling arrangement is configured to vary at least one parameter of at least each of the light-emitting sources in relation to actual circumstances of the cleaning action independently from the others of the light-emitting sources.

11. The nozzle device of claim 1, wherein, at each of the sides of the nozzle device which are configured to be at a side position during the cleaning action, the nozzle device comprises:

at least one opening providing access from an exterior to an interior of the nozzle device so as to allow the nozzle device to receive dirt as may be present on the surface to be cleaned near the sides of the nozzle device.

12. The nozzle device of claim 1, further comprising a battery configured to supply electric energy, wherein the at least one light-emitting source is powered by the battery.

13. The nozzle device of claim 1, further comprising a vacuum arrangement configured to enable the nozzle device to subject the surface to be cleaned to a vacuum cleaning action.

14. The nozzle device of claim 1, wherein the at least one light-emitting source comprises at least one LED or at least one light-outcoupling portion of a light guide that further includes a light-incoupling portion configured to receive light from a light-supplying source.

15. A cordless cleaning appliance, comprising the nozzle device of claim 1.

* * * * *